US005816564A

United States Patent [19]

Winter

[11] Patent Number: 5,816,564

[45] Date of Patent: Oct. 6, 1998

[54] SUPPORT FRAME ASSEMBLY FOR HOISTING DEVICES OPERATED BY A CABLE DRUM

[75] Inventor: Klaus-Jürgen Winter, Wetter, Germany

[73] Assignee: Mannesmann Aktiengesellschaft, Düsseldorf, Germany

[21] Appl. No.: 786,431

[22] Filed: Jan. 21, 1997

[30] Foreign Application Priority Data

Jan. 18, 1996 [DE] Germany ..... 196 02 927.9

[51] Int. Cl.[6] ..... B66D 1/00

[52] U.S. Cl. ..... 254/266

[58] Field of Search ..... 254/333, 266, 254/342, 901, 323; 242/398, 390

[56] References Cited

U.S. PATENT DOCUMENTS

| | | | |
|---|---|---|---|
| 2,512,564 | 6/1950 | Dickson | 254/266 |
| 4,736,929 | 4/1988 | McMorris | 254/323 |
| 5,098,068 | 3/1992 | Jussila | 254/342 |
| 5,186,410 | 2/1993 | Toews | 254/323 |
| 5,573,091 | 11/1996 | Hung | 254/323 |
| 5,611,522 | 3/1997 | Zaguroli, Jr. | 254/323 |

FOREIGN PATENT DOCUMENTS

| | | |
|---|---|---|
| 3405759 | 8/1985 | Germany . |
| 4310770 | 10/1994 | Germany . |

*Primary Examiner*—Katherine Matecki
*Attorney, Agent, or Firm*—Cohen, Pontani, Lieberman & Pavane

[57] ABSTRACT

A support frame assembly for a hoisting device including a cable drum pulling means mounted between two side-end members and at least two longitudinal girders arranged between the end members so that the ends of the longitudinal girders are substantially fixed in position relative to the end members. In order to reduce the expense of assembling and weight of the cable winch, the end members are clamped together in a longitudinal direction with at least one clamping means so that the ends of the longitudinal girders are, as a result, substantially fixed in position relative to the side-end members, at least in the longitudinal direction.

15 Claims, 3 Drawing Sheets

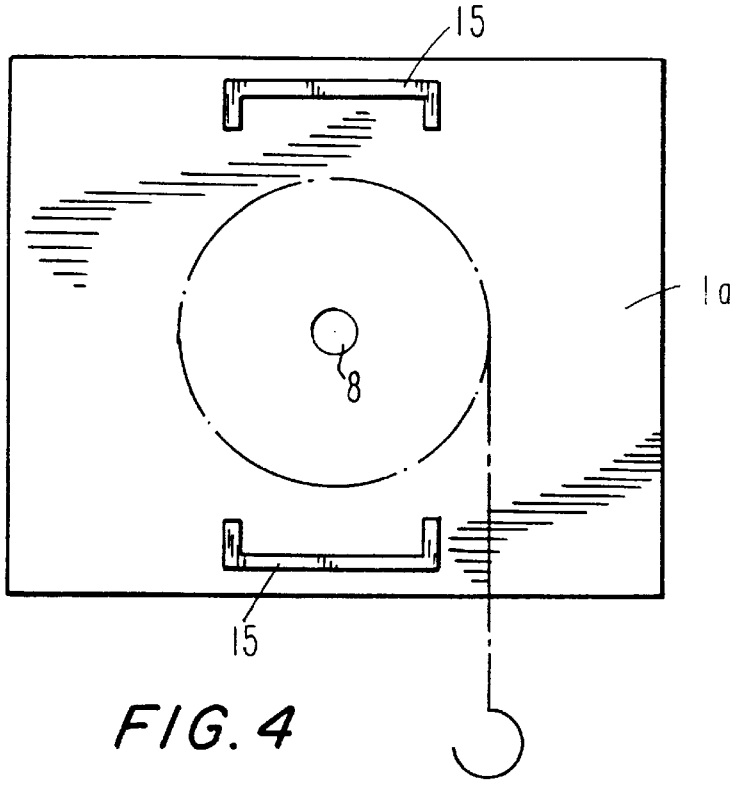
FIG. 4
FIG. 5
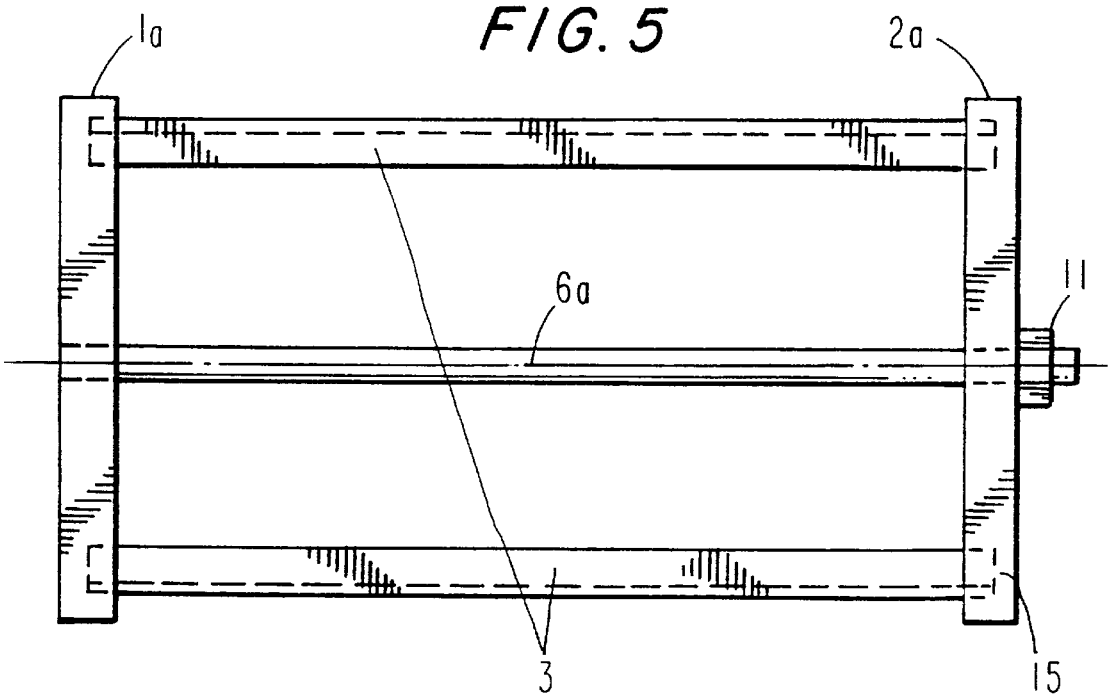

SUPPORT FRAME ASSEMBLY FOR HOISTING DEVICES OPERATED BY A CABLE DRUM

BACKGROUND OF THE INVENTION

1. Field of the Invention

The present invention relates to a support frame assembly for hoisting devices including a cable drum lifting means mounted between two side-end members and at least two longitudinal girders interposed between each of the end members so that respective ends of the longitudinal girders remain in a substantially fixed position between the end members.

2. Description of the Related Art

It is known to construct hoisting devices operated by pull or lift means, and particularly electric cable winches, using modular components including an electrical system, motor, gears, cable drum, support means and support frames. The individual modular components may be assembled in detachable fashion to thereby permit a large number of combinations or permutations. The main structural groups of the cable winch are fastened on the support frame, and in particular, the support frame bears the bearings and the drive shaft of the cable drum. A support frame consists essentially of two end plates separated from and parallel to one another. Longitudinal girders are interposed between the two end plates and fastened therebetween by at least three screw connections per end plate. This conventional support frame for cable winches has the disadvantage of a relatively high cost of assembly resulting from the screw connections. Furthermore, relatively massive longitudinal girders are required because of the mechanical loads on the support frame resulting from the drive shaft of the cable drum being mounted in the end plates. These relatively massive girders disadvantageously increase the overall weight of the support frame.

SUMMARY OF THE INVENTION

The object of the present invention is to reduce the cost of assembly and overall weight of a cable winch.

This object is achieved in accordance with the invention by a support frame assembly for a hoisting device including a drum cable pull or lift means mounted between two side-end members and at least two longitudinal girders arranged between the end members so that the respective ends of each of the girders is clamped in a substantially fixed position on the end members. The end members are clamped together by at least one tensioning or clamping means via the longitudinal girders in their longitudinal direction in such a manner that the ends of the longitudinal girders are thereby substantially fixed, at least in their lengthwise direction, on the end members. In a preferred embodiment the clamping means is a threaded rod having an external thread at least at its ends. The end members are preferably plates. One end member has a receiving opening with an internal thread to receive the threaded rod, and the other end member has an outlet opening for the threaded rod. The end members are clamped together via the threaded rod.

In one embodiment, the longitudinal girders have a U-shaped cross section, however, any other type of shape is also intended and within the scope of the invention. The end members in this embodiment are configured with depressions defined therein, which are complementary in shape to the shape of the ends of the longitudinal girders, for fixing the respective ends of the longitudinal girders. In an alternate embodiment or configuration, the ends of the longitudinal girders are fixed using projections that extend outwardly from the end members. The projections may be stop surfaces and/or cams formed by parts of the end members.

The cable drum is supported via bearings directly on a threaded rod. At least one of the end members has an opening for a drive shaft. The drive shaft has an external toothing and an inner side of the cable drum has an internal toothing, at least in the corresponding region.

In accordance with the present invention the support assembly is constructed so that the end members are clamped together by at least one clamping member in a longitudinal or axial direction with the longitudinal girders interposed therebetween so that the ends of the girders remain substantially fixed in position, at least in their longitudinal direction, relative to the end members. This configuration advantageously reduces the cost of assembling the cable winch. Furthermore, the use of clamping means to clamp the end members together allows the longitudinal girders to be arranged to provide a relatively stable, rigid and twist-free support frame construction. This advantage is due, in particular, to the fact that the clamping function is provided by a clamping means especially provided for this purpose. In accordance with the clamping means of the present invention, the longitudinal girders primarily provide stability to the shape of the support frame, substantially reducing or preventing twisting, so that, for instance, relatively rigid longitudinal girders of any desired hollow-profile cross-sectional shape may be used without substantially weakening or effecting the overall stability of the support frame.

In one embodiment of the invention, the clamping means is a threaded rod with external threads at each of its ends. For reasons of stability and simplicity, the end members are preferably plates. One of the two end members has an inlet opening with an internal thread which receives one end of the threaded rod; the other end member is provided with an outlet opening through which the threaded rod may pass and extend beyond the end member to receive a nut. Tightening the nut, for example, by screwing the nut onto the threaded rod, clamps the end members together in a longitudinal direction against the longitudinal girders interposed therebetween.

In another embodiment the longitudinal girder has a U-shaped cross section which advantageously provides relatively high stability. The ends of the longitudinal girders are fixed in a highly stable manner to the end members by inserting the ends into depressions or recesses defined in the end members, which are complementary in shape to the ends of the longitudinal girders. In an alternate embodiment or arrangement, the ends of the longitudinal girder may be fixed to the end members within projections extending outward from an inner surface of the end members. Preferably, the projections have stop surfaces separate from or integral to the end members in addition to, or in lieu of, projections, such as cams.

The weight of the support frame may be further reduced without reducing its stability by supporting a cable drum directly on the threaded rod by bearings which are for instance pushed there over with the rod defining the axis of rotation. A drive shaft extends through an opening in at least one of the end members. To drive the cable drum, the drive shaft preferably has external toothing and the inside of the cylindrical outer wall of the cable drum is provided, at least in the corresponding region, with internal toothing with which the external toothing of the drive shaft engages.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views:

FIG. 4 is a transverse cross-sectional view of a portion of the support frame of FIG. 1 with a longitudinal girder of U-shaped profile substantially fixed in position on the end member by depressions defined therein; and FIG. 5 is a top view of the support frame of FIG. 4.

DETAILED DESCRIPTION OF THE PRESENTLY PREFERRED EMBODIMENTS

Figure 1:
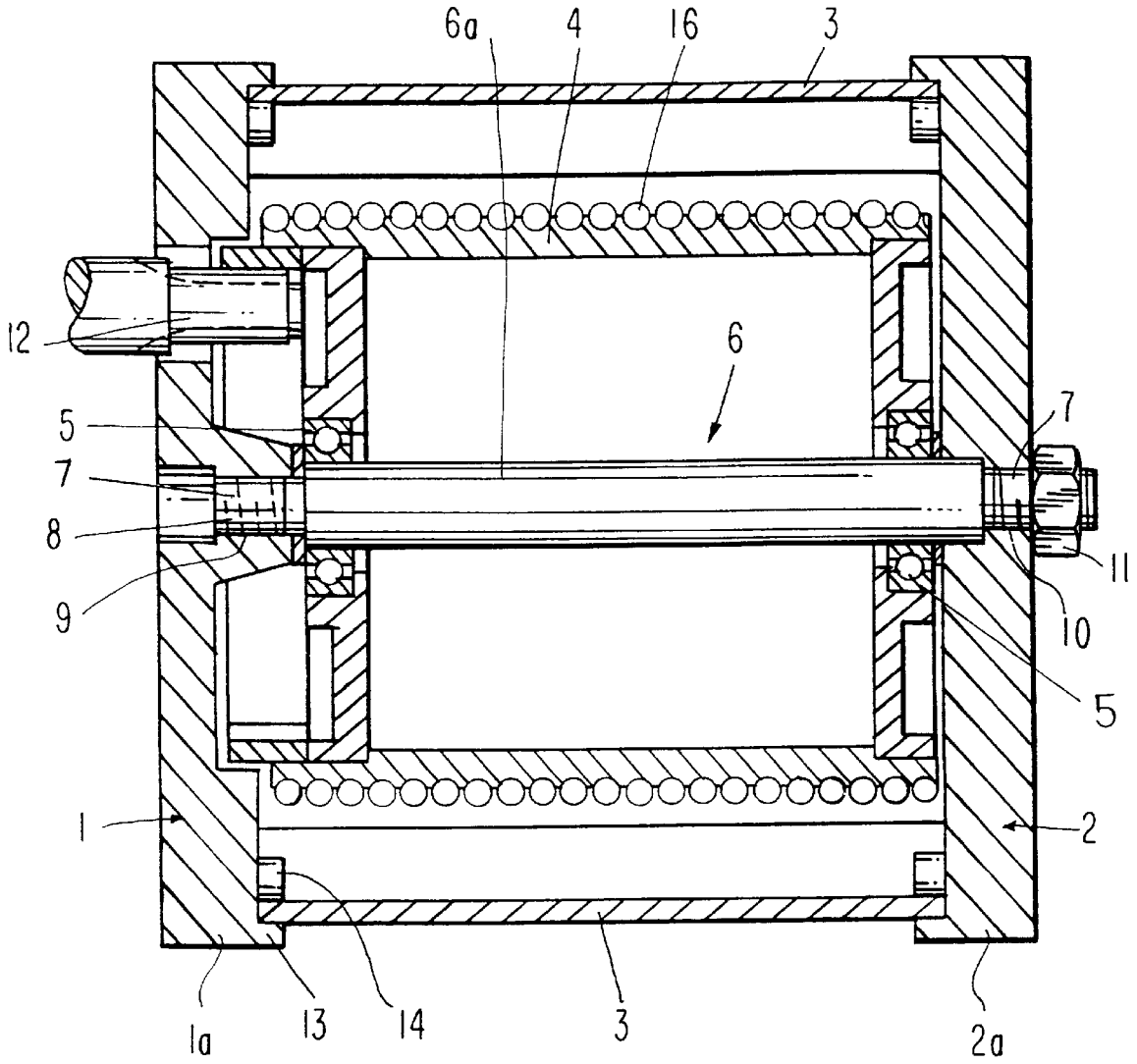
FIG. 1 is a longitudinal cross-sectional view of a support frame in accordance with the present invention including a threaded rod serving as a clamping means and a rotational axis of a cable drum.

An embodiment of the support frame construction of the present invention is shown in FIG. 1. A support frame is formed by two side-end members or members 1, 2, preferably in the form of end plates 1*a*, 2*a*, that are arranged substantially parallel to and at a distance from one another, and upper and lower longitudinal girders 3 interposed therebetween. Within the frame a rotatable cable drum 4 is supported by bearings 5 directly on a clamping means 6, such as a threaded rod 6*a*. As shown in FIG. 1, the threaded rod 6*a* is arranged approximately parallel to the longitudinal girders 3. The threaded rod 6*a* is provided at each of its ends with an external thread 7. An opening 8, with a corresponding internal thread 9, is approximately centrally defined in end plate 1. One end of the threaded rod 6*a* is received in the opening 8 and firmly connected to end plate 1*a* by screwing it thereto. The other end of the threaded rod 6*a* extends longitudinally through an approximately centrally defined opening 10 in the end plate 2*a* outward beyond the plate to receive a nut 11, whereby the end plates 1*a*, 2*a* are screwed together by the threaded rod 6*a* and the nut 11. Tightening the nut 11 causes the end plates la, 2*a* to be clamped or braced against one another in the longitudinal direction with the longitudinal girders 3 interposed therebetween to thereby form a force-locked or positive-locked connection of the end plates 1*a*, 2*a* and longitudinal girders 3.

Cable drum 4 is supported for rotation on the threaded rod 6*a* by bearings 5 and driven by a drive shaft 12. The drive shaft 12 is provided with external toothing that engage internal toothing disposed in the longitudinal direction on the inner surface of the cable drum 4 to cause the cable drum 4 to rotate. Drive shaft 12 passes through an opening in the end plate 1*a* provided for this purpose.

Figure 2:
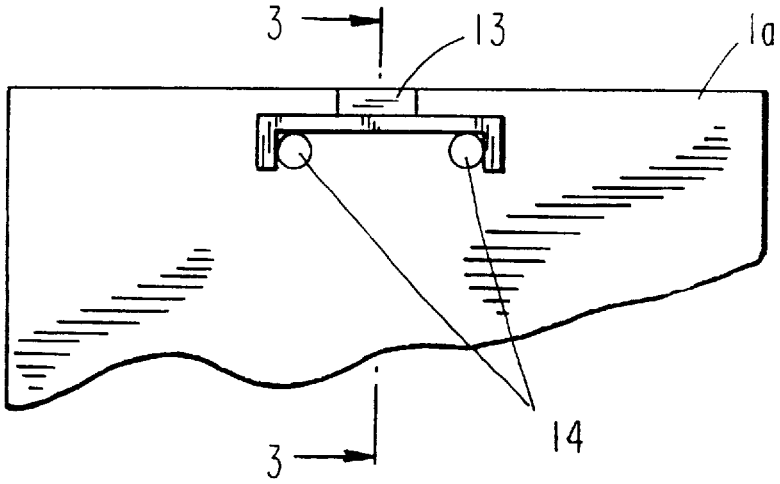
FIG. 2 is a transverse cross-sectional view of a portion of the support frame of FIG. 1 with a longitudinal girder of U-shaped profile substantially fixed in position on an end member.
Figure 3:
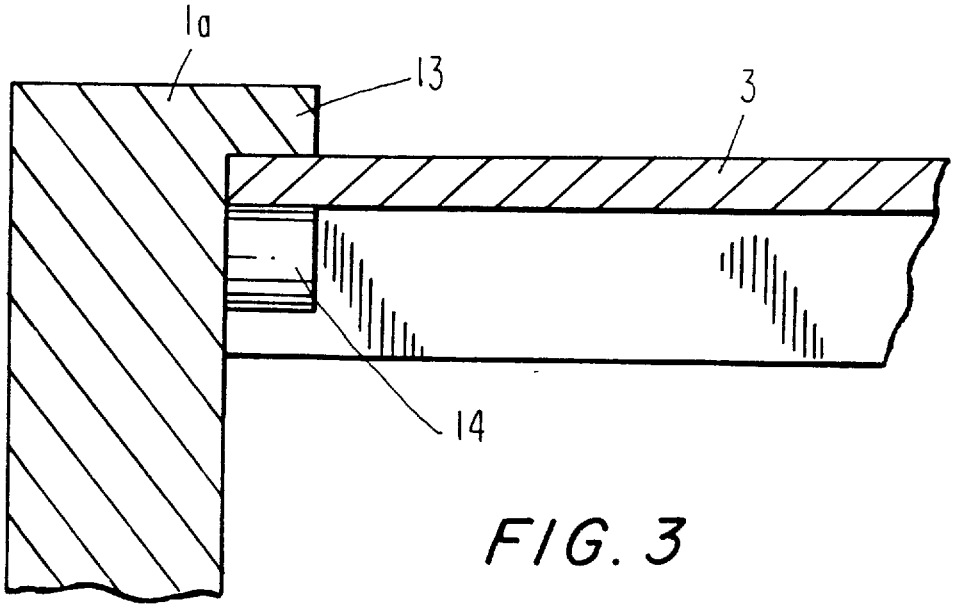
FIG. 3 is a partial cross-sectional view of one of the end members of FIG. 2 along lines A—A.

FIGS. 2 and 3 show one embodiment of a means for fixing the position of the longitudinal girders 3 relative to the end plates 1*a*, 2*a*. In this embodiment, the end plates 1*a*, 2*a* are provided with projections at appropriate or specified locations for fixing the longitudinal girders 3 between the end plates 1*a*, 2*a*. As shown in FIGS. 3 and 4, one of these projections is a stop ledge 13 arranged proximate the edge of the end plate 1*a*, 2*a*. The stop ledge 13 has a generally rectangular-shaped cross section and a stopping surface that is substantially parallel to the longitudinal direction of the support frame. Two fixed projections 14 separated from one another by a predetermined distance provide two additional projections used to fix the position of the longitudinal girders 3 relative to the end plates 1*a*, 2*a*. The projections 14 are disposed so that they define a plane which is substantially parallel to the stopping surface of the stop ledge and a longitudinal axis that extends substantially parallel to the longitudinal direction of the support frame. The longitudinal girders 3 have a cross sectional shape, as for example a generally U-shaped cross-section, of appropriate dimension so that each end thereof may be inserted, in a force-locked or positive-locked manner, into the slot formed or defined by the projections 14 and the stop ledge 13. The distance between the projections 14 is defined or selected so that at least a portion of their respective outer surfaces abut at a least a point or portion of respective inner side surfaces and an inner bottom surface of the longitudinal girder 3 when assembled, as a result of which lateral displacement of the longitudinal girder 3 is substantially reduced or prevented. In an alternative embodiment or arrangement, projections 14 may also be used instead of the stop ledge 13. Thus, the longitudinal girder 3 may be inserted substantially free of movement in a force-locked or positive-locked manner between the projections 13, 14.

Another configuration which ensures substantially movement-free fixing of the longitudinal girders 3 to the end plates 1*a*, 2*a* is shown in FIGS. 4 and 5. In this embodiment, depressions or slots or recesses 15 have a cross-sectional shape, as for example a generally U-shaped cross section, that is complementary to the cross-sectional shape of the ends of the longitudinal girder. The recesses 15 are defined at specified or appropriate locations in the end plates 1*a*, 2*a*. Thus, when assembled, a substantially movement-free force-locked or positive locked connection is formed between the end plates 1*a*, 2*a* and the longitudinal girders 3.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function is substantially the same way to achieve the same results are within the scope of the invention. It is the intention, therefore, to be limited only as indicated by the scope of the claims appended hereto.

I claim:

1. A process for substantially fixing a position of respective ends of at least two longitudinal girders interposed between and relative to two end members, said longitudinal girders and end members forming a support frame for a hoisting device, said process comprising the step of:

clamping said two end members in a longitudinal direction together against the respective ends of said at least two longitudinal girders and substantially fixing in position the respective ends of said longitudinal girders relative to said end members using a threaded rod having ends and an external thread defined around its perimeter at least in a region of the ends of the rod.

2. The process of claim 1, wherein said step of clamping said two end members further comprises the step of:

passing a threaded rod axially disposed in said support frame through a first opening in one of said end members and a second opening in the other of said end members; and longitudinally displacing said end members closer together relative to one another and fixing in position the respective ends of said longitudinal girders to said end members by tightening a nut disposed around the threaded rod.

3. A support frame assembly for a hoisting device including a cable drum, comprising:

two end members;

at least two longitudinal girders interposed between said end members, each of said longitudinal girders having respective ends; and at least one means for clamping said end members, said clamping means operatively displaced in a longitudinal direction to clamp said end members together against said longitudinal girders interposed therebetween so that the respective ends of said girders are substantially fixed, at least in the longitudinal direction, relative to said end members, wherein said clamping means is a threaded rod having ends and an external thread defined around its perimeter at least in a region of the ends of the rod.

4. The support frame of claim 3, wherein said end members are end plates.

5. The support frame of claim 3, wherein one of said end members has an opening defined therein with an internal thread for receiving the threaded rod, and the other end member having a bore defined therethrough for receiving said threaded rod.

6. The support frame of claim 5, wherein said end members are clamped together by screwing the threaded rod into the opening and bore defined in said respective end members.

7. The support frame of claim 3, wherein each of said longitudinal girders has a generally U-shaped cross-sectional shape.

8. The support frame of claim 3, wherein each of said end members have depressions defined therein for receiving and fixing the ends of said longitudinal girders, the depressions having a cross-sectional shape complementary to a cross-sectional shape of the ends of said longitudinal girders.

9. The support frame of claim 3, wherein the ends of each of said end members have projections for fixing the respective ends of said longitudinal girders therebetween.

10. The support frame of claim 9, wherein the projections comprise a stopping surface integral to said end members.

11. The support frame of claim 9, wherein said projections comprise cams integral to said end members.

12. The support frame of claim 3, further comprising bearings for supporting said cable drum directly on the threaded rod.

13. The support frame of claim 3, further comprising a drive shaft received within an opening in at least one of said end members.

14. The support frame of claim 13, wherein said drive shaft has an external toothing and an inner surface of said cable drum has an internal toothing, at least in a corresponding region.

15. A process for substantially fixing a position of respective ends of at least two longitudinal girders interposed between and relative to two end members each having a fixing element, said longitudinal girders and end members forming a support frame for a hoisting device, said process comprising the step of:

clamping said two end members in a longitudinal direction together against the respective ends of said at least two longitudinal girders disposed in the fixing elements and substantially fixing in position the respective ends of said longitudinal girders relative to the end members using a threaded rod having ends and an external thread defined around its perimeter at least in a region of the ends of the rod.

* * * * *